US009111654B2

(12) United States Patent
Giles et al.

(10) Patent No.: US 9,111,654 B2
(45) Date of Patent: Aug. 18, 2015

(54) DC ION GUIDE FOR ANALYTICAL FILTERING/SEPARATION

(75) Inventors: Kevin Giles, Stockport (GB); Martin Raymond Green, Bowdon (GB); Daniel James Kenny, Knutsford (GB); David J. Langridge, Stockport (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/003,487

(22) PCT Filed: Mar. 7, 2012

(86) PCT No.: PCT/GB2012/050502
§ 371 (c)(1),
(2), (4) Date: Oct. 29, 2013

(87) PCT Pub. No.: WO2012/120297
PCT Pub. Date: Sep. 13, 2012

(65) Prior Publication Data

US 2014/0048696 A1 Feb. 20, 2014

Related U.S. Application Data

(60) Provisional application No. 61/452,776, filed on Mar. 15, 2011.

(30) Foreign Application Priority Data

Mar. 7, 2011 (GB) ..... 1103858.5

(51) Int. Cl.
*H01J 49/26* (2006.01)
*G21K 1/00* (2006.01)
*H01J 49/42* (2006.01)
*H01J 49/28* (2006.01)

(52) U.S. Cl.
CPC . *G21K 1/00* (2013.01); *H01J 49/28* (2013.01); *H01J 49/427* (2013.01)

(58) Field of Classification Search
USPC ..... 250/281, 282, 283, 290, 291
See application file for complete search history.

(56) References Cited

U.S. PATENT DOCUMENTS

| | | | |
|---|---|---|---|
| 5,783,824 | A | 7/1998 | Baba et al. |
| 6,177,668 | B1 | 1/2001 | Hager |
| 6,838,666 | B2 | 1/2005 | Ouyang et al. |
| 7,157,698 | B2 | 1/2007 | Makarov et al. |

(Continued)

FOREIGN PATENT DOCUMENTS

| | | |
|---|---|---|
| GB | 2390935 | 1/2004 |
| WO | 2005067000 | 7/2005 |
| WO | 2007010272 | 1/2007 |

*Primary Examiner* — Nicole Ippolito
(74) *Attorney, Agent, or Firm* — Diederiks & Whitelaw, PLC

(57) ABSTRACT

An ion guide is disclosed comprising a plurality of electrodes. A first device is arranged and adapted to apply a RF voltage to at least some of the electrodes in order to form, in use, a pseudo-potential well which acts to confine ions in a first direction within the ion guide. A second device is arranged and adapted to apply a DC voltage to at least some of the electrodes in order to form, in use, a DC potential well which acts to confine ions in a second direction within the ion guide. A third device is arranged and adapted to cause ions having desired or undesired mass to charge ratios to be mass to charge ratio selectively ejected from the ion guide in the second direction.

26 Claims, 2 Drawing Sheets

(56) References Cited

U.S. PATENT DOCUMENTS

| | | | | |
|---|---|---|---|---|
| 8,227,751 | B2 | 7/2012 | Green | |
| 8,946,626 | B2 * | 2/2015 | Giles et al. | 250/292 |
| 2008/0191130 | A1 | 8/2008 | Bateman et al. | |
| 2009/0140135 | A1 | 6/2009 | Finlay | |
| 2013/0068942 | A1 * | 3/2013 | Verenchikov | 250/282 |

* cited by examiner

DC ION GUIDE FOR ANALYTICAL FILTERING/SEPARATION

CROSS-REFERENCE TO RELATED APPLICATION

This application is the National Stage of International Application No. PCT/GB2012/050502, filed 7 Mar. 2012, which claims priority from and the benefit of U.S. Provisional Patent Application Ser. No. 61/452,776 filed on 15 Mar. 2011 and United Kingdom Patent Application No. 1103858.5 filed on 7 Mar. 2011. The entire contents of these applications are incorporated herein by reference.

BACKGROUND TO THE PRESENT INVENTION

The present invention relates to a mass spectrometer and a method of mass spectrometry. The preferred embodiment relates to an ion guide and a method of guiding ions.

RF confined quadrupole field ion guides have proved to be an invaluable tool in many applications. The benefits of RF quadrupole ion guides relate to their ability to act as either a mass filter or a wide mass to charge ratio range ion guide with many applications requiring the ion guide to switch between these two modes of operation. In RF quadrupole ion guides of conventional design the mass to charge ratio filtering ability (resolving mode) is due to the quadrupole nature of the RF and DC fields experienced by the ions.

Inherent within these designs are pseudo-potential radial barriers that result in mass to charge ratio dependent confinement and transmission even when a large mass to charge ratio range is desired to be transmitted (i.e. in a non-resolving mode of operation). This results in what is referred to as a low mass to charge ratio (or mass) cut off and for wide mass to charge ratio range experiments results in loss of system duty cycle as the low mass to charge ratio cut off requires scanning. In addition, ions ejected from pseudo-potential wells tend to have a relatively large energy spread resulting in issues when attempting to couple such a device to a second analyser.

It is therefore desired to provide an improved device.

SUMMARY OF THE INVENTION

According to an aspect of the present invention there is provided an ion guide comprising:

a plurality of electrodes;

a first device arranged and adapted to apply a RF voltage to at least some of the electrodes in order to form, in use, a pseudo-potential well which acts to confine ions in a first (y) direction within the ion guide;

a second device arranged and adapted to apply a DC voltage to at least some of the electrodes in order to form, in use, a DC potential well which acts to confine ions in a second (z) direction within the ion guide; and a third device arranged and adapted to cause ions having desired or undesired mass to charge ratios to be mass to charge ratio selectively ejected from the ion guide in the second (z) direction.

The plurality of electrodes preferably comprises a plurality of segmented rod electrodes.

According to the preferred embodiment the DC potential well preferably comprises a quadratic potential well. However, according to other embodiments the DC potential well may comprise a non-quadratic potential well.

According to an embodiment the DC potential well may vary in form and/or shape and/or amplitude and/or axial position along a third (x) direction and/or as a function of time.

Ions are preferably arranged to enter the ion guide along a third (x) direction.

The first (y) direction and/or the second (z) direction and/or the third (x) direction are preferably substantially orthogonal.

The ion guide is preferably arranged and adapted to be switched between a first mode of operation wherein the ion guide is arranged to operate as an ion guide and a second mode of operation wherein the ion guide is arranged to operate as a mass filter, time of flight separator, ion mobility separator or differential ion mobility separator.

According to an embodiment the third device may be arranged and adapted to eject ions having desired or undesired mass to charge ratios from the ion guide by resonant ejection by applying an AC excitation field in the second (z) direction.

According to an embodiment the third device may be arranged and adapted to eject ions having desired or undesired mass to charge ratios from the ion guide by mass to charge ratio instability ejection by applying an AC excitation field in the second (z) direction.

According to an embodiment the third device may be arranged and adapted to eject ions having desired or undesired mass to charge ratios from the ion guide by parametric excitation by applying an AC excitation field in the second (z) direction.

According to an embodiment the third device may be arranged and adapted to eject ions having desired or undesired mass to charge ratios from the ion guide by non-linear or anharmonic resonant ejection by applying an excitation field in the second (z) direction.

In the second mode of operation ions may be separated in the third (x) direction according to their mass to charge ratio on the basis of their time of flight.

In the second mode of operation ions may be separated in the third (x) direction according to their ion mobility or on the basis of their differential ion mobility.

Ions which are ejected from the ion guide and/or ions which are transmitted through the ion guide may be arranged to undergo detection or further analysis.

The height and/or depth and/or width of the DC potential well may be arranged to vary, decrease, progressively decrease, increase or progressively increase along a or the third (x) direction so that ions are funnelled in the third (x) direction.

The ion guide may be arranged and adapted in a mode of operation to act as a gas cell or a reaction cell.

The ion guide preferably further comprises a device for applying an axial field to the ion guide along a or the third (x) direction.

The ion guide preferably further comprises a device for applying one or more travelling waves or one or more transient DC voltages to the ion guide along a or the third (x) direction.

The ion guide is preferably arranged and adapted in a mode of operation to act as an ion storage or accumulation device.

The minima of DC potential wells formed within the ion guide may be arranged to form a linear, curved or serpentine path in a or the third (x) direction.

One or more DC potential wells may be formed at different positions and/or are formed at different times within the ion guide so that ions may be switched between different paths through the ion guide.

Ions may according to one embodiment be transferred mass selectively or non mass selectively between different DC potential wells within the ion guide and are onwardly transmitted.

According to another aspect of the present invention there is provided a mass spectrometer comprising an ion guide as described above.

The ion guide may be coupled to an upstream and/or downstream mass to charge ratio analyser or ion mobility analyser.

The ion guide may be coupled to a downstream orthogonal acceleration Time of Flight analyser and the second (z) direction may be aligned with the orthogonal acceleration Time of Flight separation axis so as to improve the pre-extraction ion beam conditions or phase space resulting in improved resolution and/or sensitivity.

The ion guide may be configured either to accumulate or to onwardly transmit ions and wherein the ion guide is arranged to act as a source for another analytical device with ions ejected in an analytical or non-analytical manner in either the third (x) direction or the second (z) direction.

According to another aspect of the present invention there is provided a method of guiding ions comprising:

providing a plurality of electrodes;

applying a RF voltage to at least some of the electrodes in order to form a pseudo-potential well which acts to confine ions in a first (y) direction within the ion guide;

applying a DC voltage to at least some of the electrodes in order to form a DC potential well which acts to confine ions in a second (z) direction within the ion guide; and causing ions having desired or undesired mass to charge ratios to be mass to charge ratio selectively ejected from the ion guide in the second (z) direction.

According to the preferred embodiment a planar array of electrodes is arranged so as to provide an ion guiding device with substantially RF confinement along one axis and a substantially quadratic or non-quadratic DC confinement along a second axis. The characteristics of the DC confinement or DC potential well also preferably facilitate mass to charge ratio based separation.

According to an aspect of the present invention there is provided a mass spectrometer comprising an ion guide consisting of a 3D array of electrodes configured to give a substantially quadratic or non-quadratic DC potential along one axis orthogonal to the ion beam and a substantially RF confining potential along a second axis orthogonal to the ion beam and the DC potential. A means for switching the ion guide between a wide mass to charge ratio transmission range mode of operation and an analytical filtering/separation mode of operation is preferably provided. The analytical filtering/separation may be via resonant ejection in the quadratic DC direction of single or multiple mass to charge ratio ranges via the application of an AC excitation field in the z direction.

The analytical filtering/separation may be via mass to charge ratio instability ejection in the quadratic DC direction via the application of an AC excitation field in the z direction.

The analytical filtering/separation may be via mass to charge ratio time of flight separation.

The ejected ions and/or the transmitted ions may undergo detection or further analysis. The analytical filtering/separation may be via ion mobility or differential ion mobility separation.

An axially dependent DC potential in the z direction (e.g. funnel) may be provided.

The preferred device may act as a gas cell or a reaction cell.

The preferred device may be coupled to upstream or downstream mass to charge ratio analysers or ion mobility analysers.

The preferred device may be coupled to a downstream orthogonal acceleration Time of Flight mass analyser and the quadratic DC axis (z axis) may be aligned with the orthogonal acceleration Time of Flight separation axis so as to improve the pre-extraction ion beam conditions (phase space) resulting in an improved resolution/sensitivity characteristic.

The preferred device may include an axial field.

The preferred device may include travelling waves wherein one or more transient DC voltages are applied to the electrodes of the preferred device in order to urge ions along the length of the ion guide.

The preferred device may act as an ion storage or accumulation device.

The DC potential may not be quadratic according to a less preferred embodiment and may vary in form or amplitude as a function of axial position or as function of time.

The preferred device when configured to either accumulate or onwardly transmit ions may also act as a source for another analytical device with ions ejected in an analytical or non-analytical manner in either the axial or the DC potential (z) direction. The minima of the quadratic DC potential well within the preferred device may take a linear, curved or serpentine path.

One or more DC wells may be formed at different positions or times within the preferred device allowing ions to travel through different paths within the preferred device depending on the configuration of the applied DC potential.

Ions may be transferred mass selectively or non mass selectively between different DC wells within the preferred device and onwardly transmitted.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to the preferred embodiment the one or more transient DC voltages or potentials or the one or more DC voltage or potential waveforms create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage or potential waveforms preferably comprise a repeating waveform or square wave.

An RF voltage is preferably applied to the electrodes of the preferred device and preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

The RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz, The ion guide is preferably maintained at a pressure selected from the group comprising: (i) >0.001 mbar; (ii) >0.01 mbar; (iii) >0.1 mbar; (iv) >1 mbar; (v) >10 mbar; (vi) >100 mbar; (vii) 0.001-0.01 mbar; (viii) 0.01-0.1 mbar; (ix) 0.1-1 mbar; (x) 1-10 mbar; and (xi) 10-100 mbar.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

A preferred embodiment of the present invention will now be described.

Figure 1A:
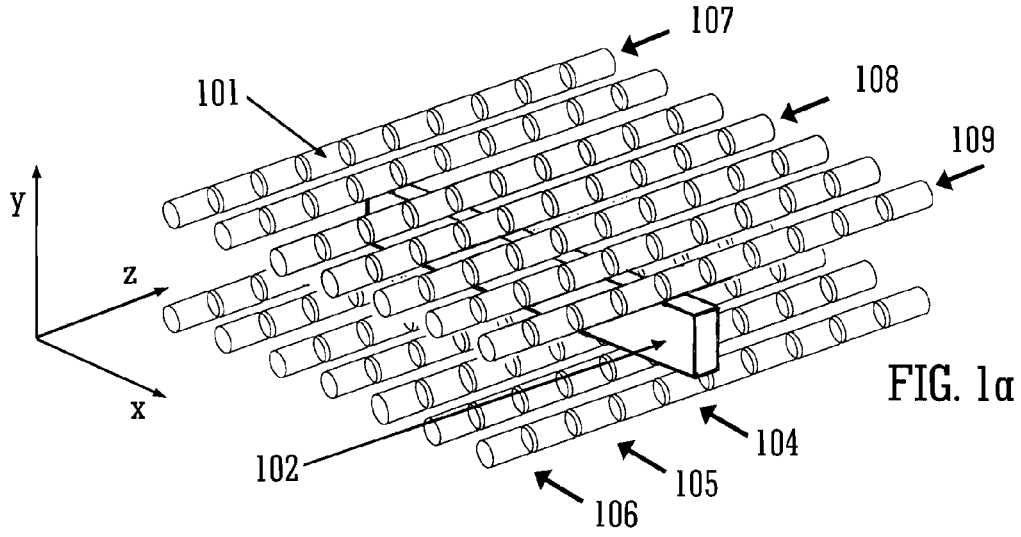
FIG. 1A shows an ion guide according to an embodiment of the present invention.
Figure 1B:
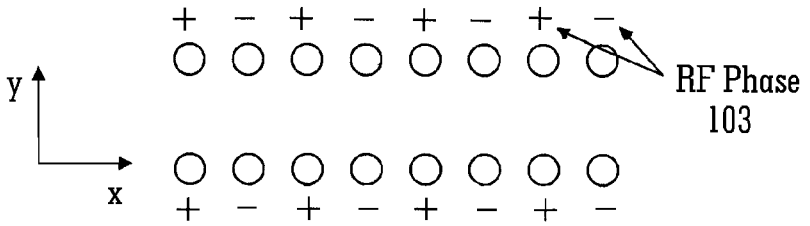
FIG. 1B shows an end view of the preferred ion guide.
Figure 1C:
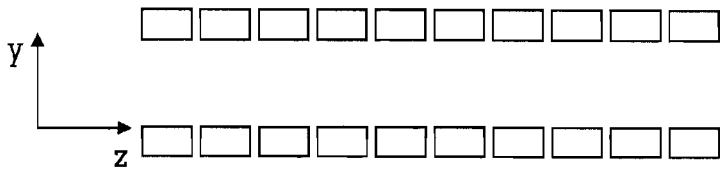
FIG. 1C shows a side view of the preferred ion guide and FIG. 1D shows a quadratic DC potential profile maintained in the z-direction.

FIGS. 1A-C are schematic representations of a preferred embodiment of the present invention. According to the preferred embodiment an ion guide is provided comprising an extended three dimensional array of electrodes 101 as shown in FIG. 1A. Ions enter the ion guide in the x-direction and occupy a volume within the ion guide as indicated by the rectangular volume 102.

Ions are confined in the y (vertical) direction by applying opposite phases of an RF voltage 103 to adjacent rows of electrodes in the x direction as can be seen from the end view shown in FIG. 1B.

FIG. 1C shows a side view of the electrode positions.

Figure 1D:
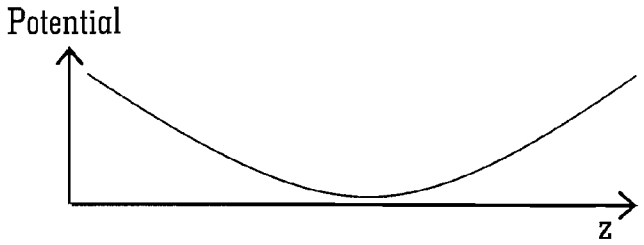

According to the preferred embodiment a DC quadratic potential is superimposed on the RF voltage applied to the plane of electrodes such that an axial DC potential well is formed in the z-direction as shown in FIG. 1D.

A distributed cloud of ions 102 is preferably arranged to enter the volume of the ion guide through either open end (y-z plane) in the x direction. The ions move towards the DC potential minimum under the influence of the DC field. Background gas may or may not be introduced to the guide volume so as to induce fragmentation and/or to collisionally cool the ion cloud such that ions are confined at the DC potential minimum in the z-direction and by the confining RF potential in the y (vertical) direction.

Confinement of ions in the z direction confinement is advantageously independent of the mass to charge ratio of the ions due to the quadratic DC potential whilst the mass to charge ratio range confined in the y (vertical) direction is much larger than that of a standard quadrupole due to the higher order non-quadrupole nature of the y direction RF fields allowing the device as a whole to transmit a wider mass to charge ratio range of ions than conventional quadrupole ion guides.

The ion guide according to the preferred embodiment is, therefore, particularly advantageous compared with conventional quadrupole ion guides.

In a mode of operation the axial DC quadratic potential may be modulated in the z-direction in such a manner as to cause mass to charge ratio selective excitation and ejection of the ion beam through the open ends of the device in the z-direction (x-y plane). Single mass to charge ratio ranges may be ejected or multiple mass to charge ratio ranges may be ejected simultaneously via this method. The fact that the quadratic potential in the direction of ejection is mass to charge ratio independent means that in situations where multiple mass to charge ratio ranges are ejected simultaneously, the mass to charge ratio versus resolution characteristic will be improved compared with quadratic pseudo-potential based ejection.

The quadratic DC amplitude or frequency of modulation can be varied to produce a mass to charge ratio spectrum. Both ions ejected in the z-direction and ions onwardly transmitted in the x-direction can be easily further analysed due to the low energy spreads.

Alternatively, the DC quadratic potential may be modulated in the z direction in such a manner as to cause mass to charge ratio dependent instability when combined with a static DC quadratic potential in the z direction. This instability can be used to eject ions in a mass to charge ratio dependent manner in the z direction. The quadratic DC amplitude and/or amplitude of modulation can be varied to produce a mass to charge ratio spectrum. Both ions ejected in the z direction and ions onwardly transmitted in the x direction can be further analysed.

Alternatively, the ion beam may be pulsed into the device and time of flight in the x direction may be used to determine the mass to charge ratio of ions. In this case the angle of the incoming ion beam may be orientated in the z direction to maximise the flight path and improve the focusing characteristics.

Alternatively, the ion beam may be injected into the ion guide when operated at elevated pressure resulting in ion mobility based separation or differential ion mobility based separation.

Figure 2A:
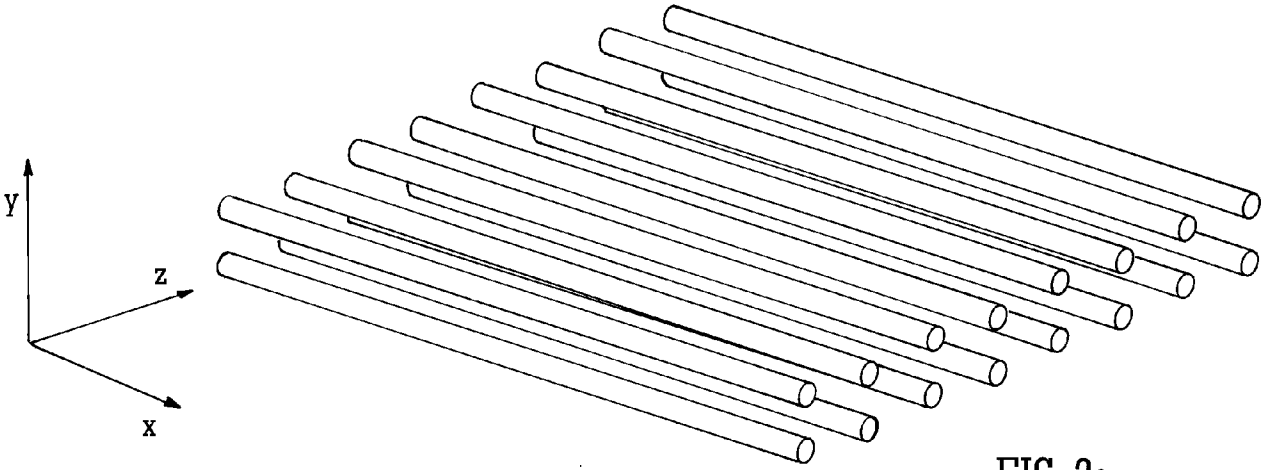
FIG. 2A shows an ion guide according to another embodiment of the present invention.
Figure 2B:
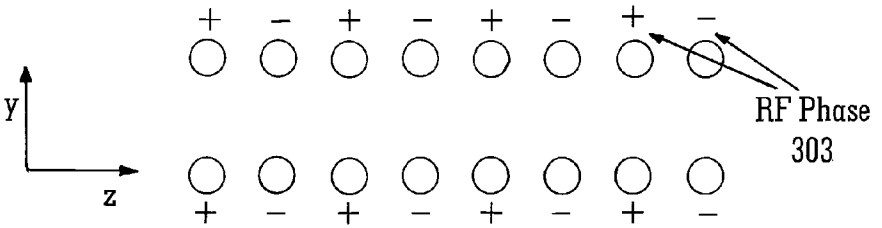
FIG. 2B shows an end view of the ion guide and FIG. 2C shows a quadratic DC potential profile maintained in the z-direction.
Figure 2C:
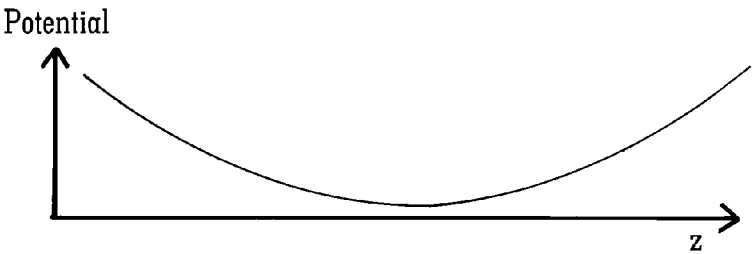

FIG. 2A shows a further embodiment of the present invention wherein a plurality of rod electrodes are arranged parallel to the x-direction. An end view of the arrangement is shown in FIG. 2B. The rod electrodes may be maintained at different DC potentials so that a quadratic DC potential well is formed in the z-direction as shown in FIG. 2C. According to this embodiment the rod electrodes are not axially segmented.

Although the present invention has been described with reference to the preferred embodiments, it will be understood by those skilled in the art that various changes in form and detail may be made without departing from the scope of the invention as set forth in the accompanying claims.

The invention claimed is:

1. An ion guide comprising:

a plurality of electrodes comprising a planar array of electrodes;

a first device arranged and adapted to apply a RF voltage to at least some of said electrodes in order to form, in use, a pseudo-potential well which acts to confine ions in a first (y) direction within said ion guide;

a second device arranged and adapted to apply a DC voltage to at least some of said electrodes in order to form, in use, a DC potential well which acts to confine ions in a second (z) direction within said ion guide; and a third device arranged and adapted to cause ions having desired or undesired mass to charge ratios to be mass to charge ratio selectively ejected from said ion guide in said second (z) direction;

wherein ions are arranged to enter said ion guide along a third (x) direction; and wherein said DC potential well comprises a quadratic potential well.

2. An ion guide as claimed in claim 1, wherein said DC potential well varies in form or shape or amplitude or axial position along a third (x) direction or as a function of time.

3. An ion guide as claimed in claim 1, wherein said first (y) direction or said second (z) direction or said third (x) direction are substantially orthogonal.

4. An ion guide as claimed in claim 1, wherein said ion guide is arranged and adapted to be switched between a first mode of operation wherein said ion guide is arranged to operate as an ion guide and a second mode of operation wherein said ion guide is arranged to operate as a mass filter, time of flight separator, ion mobility separator or differential ion mobility separator.

5. An ion guide as claimed in claim 4, wherein in said second mode of operation ions are separated in said third (x) direction according to their mass to charge ratio on the basis of their time of flight.

6. An ion guide as claimed in claim 4, wherein in said second mode of operation ions are separated in said third (x) direction according to their ion mobility or on the basis of their differential ion mobility.

7. An ion guide as claimed in claim 1, wherein said third device is arranged and adapted to eject ions from the ion guide having desired or undesired mass to charge ratios by resonant ejection by applying an AC excitation field in said second (z) direction.

8. An ion guide as claimed in claim 1, wherein said third device is arranged and adapted to eject ions having desired or undesired mass to charge ratios from said ion guide by mass to charge ratio instability ejection by applying an AC excitation field in said second (z) direction.

9. An ion guide as claimed in claim 1, wherein said third device is arranged and adapted to eject ions having desired or undesired mass to charge ratios from said ion guide by parametric excitation by applying an AC excitation field in said second (z) direction.

10. An ion guide as claimed in claim 1, wherein said third device is arranged and adapted to eject ions having desired or undesired mass to charge ratios from said ion guide by non-linear or anharmonic resonant ejection by applying an excitation field in said second (z) direction.

11. An ion guide as claimed in claim 1, wherein ions which are ejected from said ion guide or ions which are transmitted through said ion guide are arranged to undergo detection or further analysis.

12. An ion guide as claimed in claim 1, wherein a height or depth or width of said DC potential well is arranged to vary, decrease, progressively decrease, increase or progressively increase along said third (x) direction so that ions are funneled in said third (x) direction.

13. An ion guide as claimed in claim 1, wherein said ion guide is arranged and adapted in a mode of operation to act as a gas cell or a reaction cell.

14. An ion guide as claimed in claim 1, further comprising a device for applying an axial field to said ion guide along said third (x) direction.

15. An ion guide as claimed in claim 1, further comprising a device for applying one or more travelling waves or one or more transient DC voltages to said ion guide along said third (x) direction.

16. An ion guide as claimed in claim 1, wherein said ion guide is arranged and adapted in a mode of operation to act as an ion storage or accumulation device.

17. An ion guide as claimed in claim 1, wherein minima of DC potential wells formed within the ion guide form a linear, curved or serpentine path in said third (x) direction.

18. An ion guide as claimed in claim 1, wherein one or more DC potential wells are formed at different positions or are formed at different times within said ion guide so that ions may be switched between different paths through said ion guide.

19. An ion guide as claimed in claim 1, wherein ions are transferred mass selectively or non mass selectively between different DC potential wells within said ion guide and are onwardly transmitted.

20. A mass spectrometer comprising an ion guide as claimed in claim 1.

21. A mass spectrometer as claimed in claim 20, wherein said ion guide is coupled to an upstream or downstream mass to charge ratio analyser or ion mobility analyser.

22. A mass spectrometer as claimed in claim 20, wherein the ion guide is coupled to a downstream orthogonal acceleration Time of Flight analyser and the second (z) direction is aligned with the orthogonal acceleration Time of Flight separation axis so as to improve the pre-extraction ion beam conditions or phase space resulting in improved resolution or sensitivity.

23. A mass spectrometer as claimed in claim 20, wherein said ion guide is configured either to accumulate or to onwardly transmit ions and wherein said ion guide is arranged to act as a source for another analytical device with ions ejected in an analytical or non-analytical manner in either said third (x) direction or said second (z) direction.

24. A mass spectrometer as claimed in claim 1, wherein the plurality of electrodes comprises a plurality of segmented rod electrodes arranged parallel to the second (z) direction.

25. A mass spectrometer as claimed in claim 1, wherein the plurality of electrodes comprises a plurality of rod electrodes arranged parallel to the third (x) direction.

26. A method of guiding ions with an ion guide including a plurality of electrodes having a planar array of electrodes, said method comprising:

applying a RF voltage to at least some of said electrodes in order to form a pseudo-potential well which acts to confine ions in a first (y) direction within said ion guide;

applying a DC voltage to at least some of said electrodes in order to form a DC potential well which acts to confine ions in a second (z) direction within said ion guide, wherein said DC potential well comprises a quadratic potential well;

causing ions to enter said ion guide along a third (x) direction; and causing ions having desired or undesired mass to charge ratios to be mass to charge ratio selectively ejected from said ion guide in said second (z) direction.

* * * * *